US008421735B2

(12) United States Patent
Kim et al.

(10) Patent No.: US 8,421,735 B2
(45) Date of Patent: Apr. 16, 2013

(54) LIQUID CRYSTAL DISPLAY DEVICE

(75) Inventors: Young-Ho Kim, Paju-si (KR); Sung-Jo Koo, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 670 days.

(21) Appl. No.: 12/628,942

(22) Filed: Dec. 1, 2009

(65) Prior Publication Data

US 2010/0164852 A1 Jul. 1, 2010

(30) Foreign Application Priority Data

Dec. 29, 2008 (KR) ..... 10-2008-0135360

(51) Int. Cl.
*G09G 3/36* (2006.01)

(52) U.S. Cl.
USPC ..... 345/99

(58) Field of Classification Search ..... None
See application file for complete search history.

(56) References Cited

U.S. PATENT DOCUMENTS 4,806,920 A * 2/1989 Sawada ..... 345/658
5,684,502 A * 11/1997 Fukui et al. ..... 345/95
5,966,115 A 10/1999 Aoki

FOREIGN PATENT DOCUMENTS

| | | | |
|---|---|---|---|
| JP | 6-289360 | A | 10/1994 |
| JP | 7-152339 | A | 6/1995 |
| JP | 9-190163 | A | 7/1997 |
| JP | 2006-58664 | A | 3/2006 |

* cited by examiner

*Primary Examiner* — K. Wong
(74) *Attorney, Agent, or Firm* — Birch, Stewart, Kolasch & Birch, LLP

(57) ABSTRACT

Disclosed herein is a liquid crystal display device in which an image can be correctly seen even though a screen is rotated. The liquid crystal display device includes a storage unit for storing a plurality of screen change signals, and a timing controller for dividing image data of one horizontal line externally supplied thereto into k odd sub-image data and k even sub-image data, and sequentially outputting the k odd sub-image data and sequentially outputting the k even sub-image data.

1 Claim, 8 Drawing Sheets

FIG. 3

TC

| TCON Output Data | | | | | | | | | | | | | | | | |
|---|---|---|---|---|---|---|---|---|---|---|---|---|---|---|---|---|
| Data pin | LP1 | LP2 | LP3 | LP4 | LP5 | LP6 | LP7 | LP8 | RP1 | RP2 | RP3 | RP4 | RP5 | RP6 | RP7 | RP8 |
| ··· | 1R | 1G | 1B | 1U | 2R | 2G | 2B | 2U | (n+1)R | (n+1)G | (n+1)B | (n+1)U | (n+2)R | (n+2)G | (n+2)B | (n+2)U |
| ··· | ··· | ··· | ··· | ··· | ··· | ··· | ··· | ··· | ··· | ··· | ··· | ··· | ··· | ··· | ··· | ··· |
| ··· | (n-1)R | (n-1)G | (n-1)B | (n-1)U | nR | nG | nB | nU | (2n-1)R | (2n-1)G | (2n-1)B | (2n-1)U | 2nR | 2nG | 2nB | 2nU |

FIG. 4

TC

| TCON Output Data | | | | | | | | | | | | | | | | |
|---|---|---|---|---|---|---|---|---|---|---|---|---|---|---|---|---|
| Data pin | LP1 | LP2 | LP3 | LP4 | LP5 | LP6 | LP7 | LP8 | RL1 | RL2 | RL3 | RL4 | RL5 | RL6 | RL7 | RL8 |
| ··· | 1B | 1G | 1R | 1U | 2B | 2G | 2R | 2U | (n+1)B | (n+1)G | (n+1)R | (n+1)U | (n+2)B | (n+2)G | (n+2)R | (n+2)U |
| ··· | ··· | ··· | ··· | ··· | ··· | ··· | ··· | ··· | ··· | ··· | ··· | ··· | ··· | ··· | ··· | ··· |
| ··· | (n-1)B | (n-1)G | (n-1)R | (n-1)U | nB | nG | nR | nU | (2n-1)B | (2n-1)G | (2n-1)R | (2n-1)U | 2nB | 2nG | 2nR | 2nU |

FIG. 5

TC

| TCON Output Data | | | | | | | | | | | | | | | | |
|---|---|---|---|---|---|---|---|---|---|---|---|---|---|---|---|---|
| Data pin | LP1 | LP2 | LP3 | LP4 | LP5 | LP6 | LP7 | LP8 | RL1 | RL2 | RL3 | RL4 | RL5 | RL6 | RL7 | RL8 |
| ··· | 2B | 2G | 2R | 2U | 1B | 1G | 1R | 1U | (n+2)B | (n+2)G | (n+2)R | (n+2)U | (n+1)B | (n+1)G | (n+1)R | (n+1)U |
| ··· | ··· | ··· | ··· | ··· | ··· | ··· | ··· | ··· | ··· | ··· | ··· | ··· | ··· | ··· | ··· | ··· |
| ··· | nB | nG | nR | nU | (n-1)B | (n-1)G | (n-1)R | (n-1)U | (2n-1)B | 2nG | 2nR | 2nU | (2n-1)B | (2n-1)G | (2n-1)R | (2n-1)U |

FIG. 6

TC

| TCON Output Data | | | | | | | | | | | | | | | | |
|---|---|---|---|---|---|---|---|---|---|---|---|---|---|---|---|---|
| Data pin | LP1 | LP2 | LP3 | LP4 | LP5 | LP6 | LP7 | LP8 | RP1 | RP2 | RP3 | RP4 | RP5 | RP6 | RP7 | RP8 |
| ··· | 0U | 0R | 0G | 0B | 1U | 1R | 1G | 1B | nU | nR | nG | nB | (n+1)U | (n+1)R | (n+1)G | (n+1)B |
| ··· | ··· | ··· | ··· | ··· | ··· | ··· | ··· | ··· | ··· | ··· | ··· | ··· | ··· | ··· | ··· | ··· |
| ··· | (n-2)U | (n-2)R | (n-2)G | (n-2)B | (n-1)U | (n-1)R | (n-1)G | (n-1)B | (2n-2)U | (2n-2)R | (2n-2)G | (2n-2)B | (2n-1)U | (2n-1)R | (2n-1)G | (2n-1)B |

FIG. 7

TC

| TCON Output Data | | | | | | | | | | | | | | | | |
|---|---|---|---|---|---|---|---|---|---|---|---|---|---|---|---|---|
| Data pin | LP1 | LP2 | LP3 | LP4 | LP5 | LP6 | LP7 | LP8 | RP1 | RP2 | RP3 | RP4 | RP5 | RP6 | RP7 | RP8 |
| ··· | (n+1)R | (n+1)G | (n+1)B | (n+1)U | (n+2)R | (n+2)G | (n+2)B | (n+2)U | 1R | 1G | 1B | nU | 2R | 2G | 2B | 2U |
| ··· | ··· | ··· | ··· | ··· | ··· | ··· | ··· | ··· | ··· | ··· | ··· | ··· | ··· | ··· | ··· | ··· |
| ··· | (2n-1)R | (2n-1)G | (2n-1)B | (2n-1)U | 2nR | 2nG | 2nB | 2nU | (n-1)R | (n-1)G | (n-1)B | (n-1)U | nR | nG | nB | nU |

FIG. 8

TC

| TCON Output Data | | | | | | | | | | | | | | | | |
|---|---|---|---|---|---|---|---|---|---|---|---|---|---|---|---|---|
| Data pin | LP1 | LP2 | LP3 | LP4 | LP5 | LP6 | LP7 | LP8 | RP1 | RP2 | RP3 | RP4 | RP5 | RP6 | RP7 | RP8 |
| ··· | (n+1)U | (n+1)R | (n+1)G | (n+1)B | (n+2)U | (n+2)R | (n+2)G | (n+2)B | 1U | 1R | 1G | 1B | 2U | 2R | 2G | 2B |
| ··· | ··· | ··· | ··· | ··· | ··· | ··· | ··· | ··· | ··· | ··· | ··· | ··· | ··· | ··· | ··· | ··· |
| ··· | (2n-1)U | (2n-1)R | (2n-1)G | (2n-1)B | (2n-1)U | (2n-1)R | (2n-1)G | (2n-1)B | (n-1)U | (n-1)R | (n-1)G | (n-1)B | nU | nR | nG | nB |

LIQUID CRYSTAL DISPLAY DEVICE

This application claims the benefit of the Korean Patent Application No. 10-2008-0135360 filed on Dec. 29, 2008, which is hereby incorporated by reference as if fully set forth herein.

BACKGROUND OF THE INVENTION

1. Field of the Invention

The present invention relates to a liquid crystal display device, and more particularly, to a liquid crystal display device in which an image can be correctly seen even though a screen is rotated.

2. Discussion of the Related Art

A liquid crystal display device is adapted to display an image by adjusting light transmittance of liquid crystal cells depending on a video signal. A liquid crystal display device of an active matrix type is advantageous to the display of a moving image in that a switching element is formed for every pixel cell therein. A thin film transistor (TFT) is mainly used as the switching element.

Such a conventional liquid crystal display device has a disadvantage in that an image is not correctly displayed when a screen is rotated.

SUMMARY OF THE INVENTION

Accordingly, the present invention is directed to a liquid crystal display device that substantially obviates one or more problems due to limitations and disadvantages of the related art.

An object of the present invention is to provide a liquid crystal display device which is capable of changing output positions of image data through various data mappings to show a correct image even when a screen is rotated.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display device includes: a storage unit for storing a plurality of screen change signals; and a timing controller for dividing image data of one horizontal line externally supplied thereto into k odd sub-image data and k even sub-image data, and sequentially outputting the k odd sub-image data and sequentially outputting the k even sub-image data, wherein the timing controller changes output positions of the image data of the one horizontal line in at least one of a first mode of, in response to a selected one of the screen change signals stored in the storage unit, changing output positions of image data included in at least one of the odd sub-image data and changing output positions of image data included in at least one of the even sub-image data and a second mode of changing output positions of the k odd sub-image data and k even sub-image data in response to a selected different one of the screen change signals stored in the storage unit.

The liquid crystal display device may further include a data driver including k odd latches for sequentially receiving the k odd sub-image data from the timing controller and sequentially latching the received k odd sub-image data, and k even latches for sequentially receiving the k even sub-image data from the timing controller and sequentially latching the received k even sub-image data, wherein the data driver changes a latch order of the odd latches and a latch order of the even latches in response to the selected one of the screen change signals stored in the storage unit when the timing controller changes the output positions of the image data of the one horizontal line in the first mode.

The liquid crystal display device may further include a line memory for storing the image data of the one horizontal line externally supplied to the timing controller so that the timing controller can change the output positions of the image data of the one horizontal line in any one mode including the second mode.

Each of the k odd and even sub-image data may include first red image data, first green image data, first blue image data, first red/green/blue image data, second red image data, second green image data, second blue image data, and second red/green/blue image data, wherein the first red/green/blue image data includes a most significant bit of the first red image data, a most significant bit of the first green image data, and a most significant bit of the first blue image data, wherein the second red/green/blue image data includes a most significant bit of the second red image data, a most significant bit of the second green image data, and a most significant bit of the second blue image data.

In the first mode, the timing controller may output the first blue image data in the odd sub-image data through a first odd output pin, output the first green image data in the odd sub-image data through a second odd output pin, output the first red image data in the odd sub-image data through a third odd output pin, output the first red/green/blue image data in the odd sub-image data through a fourth odd output pin, output the second blue image data in the odd sub-image data through a fifth odd output pin, output the second green image data in the odd sub-image data through a sixth odd output pin, output the second red image data in the odd sub-image data through a seventh odd output pin, output the second red/green/blue image data in the odd sub-image data through an eighth odd output pin, output the first blue image data in the even sub-image data through a first even output pin, output the first green image data in the even sub-image data through a second even output pin, output the first red image data in the even sub-image data through a third even output pin, output the first red/green/blue image data in the even sub-image data through a fourth even output pin, output the second blue image data in the even sub-image data through a fifth even output pin, output the second green image data in the even sub-image data through a sixth even output pin, output the second red image data in the even sub-image data through a seventh even output pin, and output the second red/green/blue image data in the even sub-image data through an eighth even output pin.

Alternatively, in the first mode, the timing controller may output the second blue image data in the odd sub-image data through a first odd output pin, output the second green image data in the odd sub-image data through a second odd output pin, output the second red image data in the odd sub-image data through a third odd output pin, output the second red/green/blue image data in the odd sub-image data through a fourth odd output pin, output the first blue image data in the odd sub-image data through a fifth odd output pin, output the first green image data in the odd sub-image data through a sixth odd output pin, output the first red image data in the odd sub-image data through a seventh odd output pin, output the first red/green/blue image data in the odd sub-image data through an eighth odd output pin, output the second blue image data in the even sub-image data through a first even output pin, output the second green image data in the even sub-image data through a second even output pin, output the second red image data in the even sub-image data through a third even output pin, output the second red/green/blue image data in the even sub-image data through a fourth even output pin, output the first blue image data in the even sub-image data through a fifth even output pin, output the first green image data in the even sub-image data through a sixth even output pin, output the first red image data in the even sub-image data through a seventh even output pin, and output the first red/green/blue image data in the even sub-image data through an eighth even output pin.

As another alternative, in the first mode, the timing controller may output the first red/green/blue image data in the odd sub-image data through a first odd output pin, output the first red image data in the odd sub-image data through a second odd output pin, output the first green image data in the odd sub-image data through a third odd output pin, output the first blue image data in the odd sub-image data through a fourth odd output pin, output the second red/green/blue image data in the odd sub-image data through a fifth odd output pin, output the second red image data in the odd sub-image data through a sixth odd output pin, output the second green image data in the odd sub-image data through a seventh odd output pin, output the second blue image data in the odd sub-image data through an eighth odd output pin, output the first red/green/blue image data in the even sub-image data through a first even output pin, output the first red image data in the even sub-image data through a second even output pin, output the first green image data in the even sub-image data through a third even output pin, output the first blue image data in the even sub-image data through a fourth even output pin, output the second red/green/blue image data in the even sub-image data through a fifth even output pin, output the second red image data in the even sub-image data through a sixth even output pin, output the second green image data in the even sub-image data through a seventh even output pin, and output the second blue image data in the even sub-image data through an eighth even output pin.

In the second mode, the timing controller may output the first red image data in the even sub-image data through a first odd output pin, output the first green image data in the even sub-image data through a second odd output pin, output the first blue image data in the even sub-image data through a third odd output pin, output the first red/green/blue image data in the even sub-image data through a fourth odd output pin, output the second red image data in the even sub-image data through a fifth odd output pin, output the second green image data in the even sub-image data through a sixth odd output pin, output the second blue image data in the even sub-image data through a seventh odd output pin, output the second red/green/blue image data in the even sub-image data through an eighth odd output pin, output the first red image data in the odd sub-image data through a first even output pin, output the first green image data in the odd sub-image data through a second even output pin, output the first blue image data in the odd sub-image data through a third even output pin, output the first red/green/blue image data in the odd sub-image data through a fourth even output pin, output the second red image data in the odd sub-image data through a fifth even output pin, output the second green image data in the odd sub-image data through a sixth even output pin, output the second blue image data in the odd sub-image data through a seventh even output pin, and output the second red/green/blue image data in the odd sub-image data through an eighth even output pin.

In a combination of the first and second modes, the timing controller may output the first red/green/blue image data in the even sub-image data through a first odd output pin, output the first red image data in the even sub-image data through a second odd output pin, output the first green image data in the even sub-image data through a third odd output pin, output the first blue image data in the even sub-image data through a fourth odd output pin, output the second red/green/blue image data in the even sub-image data through a fifth odd output pin, output the second red image data in the even sub-image data through a sixth odd output pin, output the second green image data in the even sub-image data through a seventh odd output pin, output the second blue image data in the even sub-image data through an eighth odd output pin, output the first red/green/blue image data in the odd sub-image data through a first even output pin, output the first red image data in the odd sub-image data through a second even output pin, output the first green image data in the odd sub-image data through a third even output pin, output the first blue image data in the odd sub-image data through a fourth even output pin, output the second red/green/blue image data in the odd sub-image data through a fifth even output pin, output the second red image data in the odd sub-image data through a sixth even output pin, output the second green image data in the odd sub-image data through a seventh even output pin, and output the second blue image data in the odd sub-image data through an eighth even output pin.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 3 is a view showing an arranged state of image data of one horizontal line stored in the timing controller under the condition that a separate data mapping is not performed;

FIG. 4 is a view illustrating a data mapping according to a first embodiment of the present invention;

FIG. 5 is a view illustrating a data mapping according to a second embodiment of the present invention;

FIG. 6 is a view illustrating a data mapping according to a third embodiment of the present invention;

FIG. 7 is a view illustrating a data mapping according to a fourth embodiment of the present invention; and FIG. 8 is a view illustrating a data mapping according to a fifth embodiment of the present invention.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
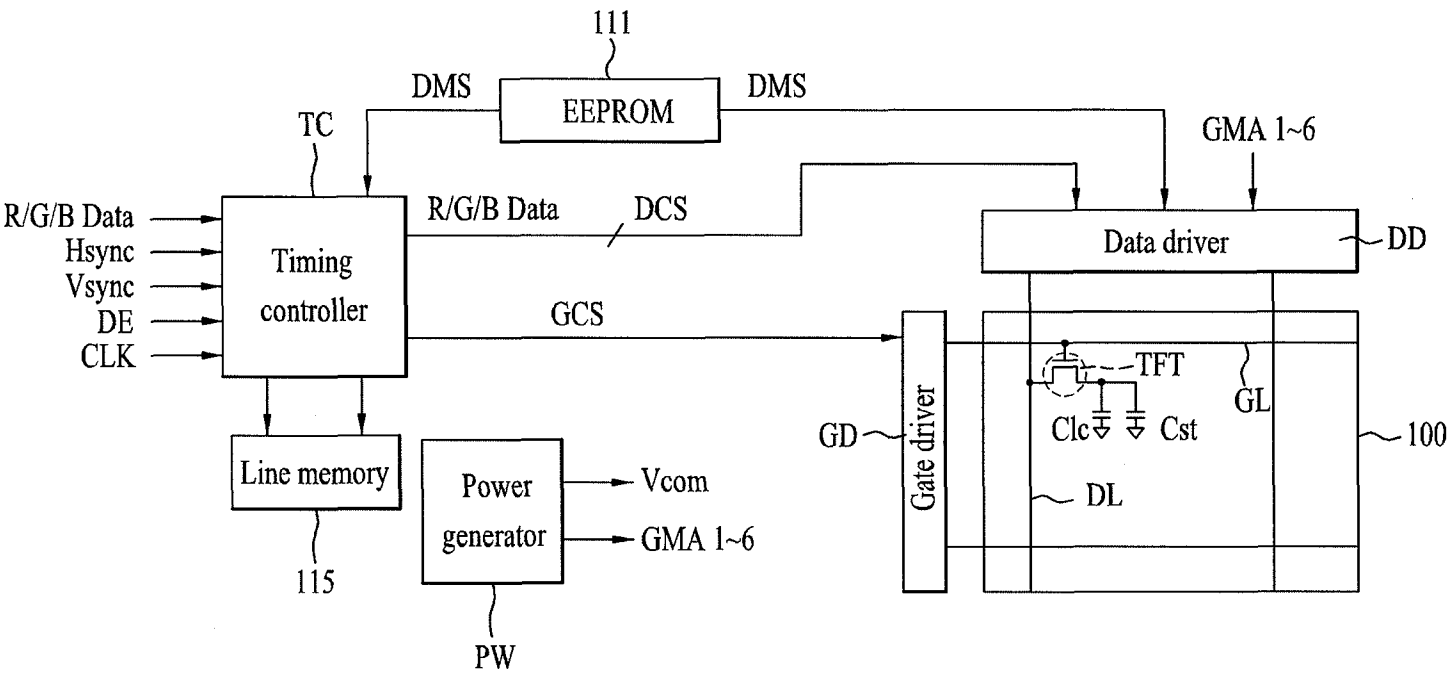
FIG. 1 is a schematic view of a liquid crystal display device according to an exemplary embodiment of the present invention.

FIG. 1 is a schematic view of a liquid crystal display device according to an exemplary embodiment of the present invention.

The liquid crystal display device according to the present embodiment includes, as shown in FIG. 1, a display panel 100 including a plurality of gate lines GL and a plurality of data lines DL arranged to intersect each other and a plurality of thin film transistors TFT formed respectively at respective intersections of the gate lines GL and data lines DL, a data driver DD for inputting data to the data lines DL of the display panel 100, a gate driver GD for inputting scan pulses to the gate lines GL of the display panel 100, and a timing controller TC for controlling the data driver DD and the gate driver GD.

Each pixel includes a thin film transistor TFT for switching data from a data line DL in response to a scan pulse from a gate line GL, and a liquid crystal cell for displaying an image based on the data switched by the thin film transistor TFT. The thin film transistor TFT has a source electrode connected to the data line DL, a drain electrode connected to a pixel electrode of the liquid crystal cell, and a gate electrode connected to the gate line GL. The display panel 100 includes a color filter array substrate and a TFT array substrate bonded to each other with a liquid crystal layer interposed therebetween. A color filter and a common electrode are formed on the color filter array substrate. Red, green and blue color filter layers are disposed in the color filter to transmit lights of specific wavelength bands, respectively, thereby enabling a color display. A black matrix is formed between adjacent ones of the color filter layers.

Each liquid crystal cell includes a liquid crystal capacitor Clc for holding data for one frame period, and an auxiliary capacitor for stably maintaining the data for the one frame period.

The timing controller TC generates data control signals DCS and gate control signals GCS using a horizontal synchronous signal Hsync, a vertical synchronous signal Vsync and a clock signal CLK inputted thereto and supplies the generated data control signals DCS and gate control signals GCS to the data driver DD and gate driver GD, respectively. The data control signals DCS include a dot clock, a source shift clock, a source enable signal, a polarity inversion signal, etc. The gate control signals GCS inputted to the gate driver GD include a gate start pulse, a gate shift clock, a gate output enable signal, etc.

The data driver DD samples data in response to the data control signals DCS from the timing controller TC, latches the sampled data on a line basis for every horizontal time (1H, 2H, . . . ), and supplies the latched data to the data lines DL. That is, the data driver DD converts data R, G and B from the timing controller TC into analog pixel signals using gamma voltages GAM1 to GAM6 inputted from a power generator PW and supplies the converted analog pixel signals to the data lines DL.

The gate driver GD includes a shift register for sequentially generating scan pulses in response to the gate start pulse among the gate control signals GCS from the timing controller TC, and a level shifter for shifting the voltage level of each scan pulse to a voltage level suitable for driving of a corresponding liquid crystal cell. The gate driver GD sequentially supplies gate high voltages to the gate lines GL in response to the gate control signals GCS.

The power generator PW supplies a common electrode voltage Vcom to the display panel 100 and the gamma voltages GAM1 to GAM6 to the data driver DD, respectively.

On the other hand, the timing controller TC divides image data of one horizontal line externally supplied thereto into k odd sub-image data and k even sub-image data, and sequentially outputs the k (where k is a natural number) odd sub-image data and sequentially outputs the k even sub-image data.

At this time, the timing controller TC maps the image data of the one horizontal line in response to any one screen change signal DMS selected from a storage unit 111 to change output positions of the image data of the one horizontal line. At this time, the timing controller TC changes the output positions of the image data of the one horizontal line in any one of a first mode and a second mode or a combination of the first and second modes based on the selected screen change signal DMS.

That is, in the first mode, the timing controller TC changes output positions of image data included in at least one of the k odd sub-image data and changes output positions of image data included in at least one of the k even sub-image data. In detail, in the first mode, there is a change in output position among image data in one sub-image data (odd sub-image data or even sub-image data).

Also, in the second mode, the timing controller TC changes output positions between the k odd sub-image data and the k even sub-image data. In detail, in the second mode, there is a change in output position between image data in the odd sub-image data and image data in the even sub-image data.

The data driver DD includes k odd latches for sequentially receiving the k odd sub-image data from the timing controller TC and sequentially latching the received k odd sub-image data, and k even latches for sequentially receiving the k even sub-image data from the timing controller TC and sequentially latching the received k even sub-image data.

When the timing controller TC changes output positions of image data of one horizontal line in the first mode, the data driver DD changes the latch order of the odd latches and the latch order of the even latches in response to a screen change signal DMS from the storage unit 111. That is, the data driver DD may make the odd latches latch in order from the leftmost odd latch to the rightmost odd latch or from the rightmost odd latch to the leftmost odd latch. Also, the data driver DD may make the even latches latch in order from the leftmost even latch to the rightmost even latch or from the rightmost even latch to the leftmost even latch. The storage unit 111 stores a plurality of screen change signals DMS, and the timing controller TC selects one of a plurality of data mapping modes to be described later in response to any one of the screen change signals DMS and controls output positions of image data of one horizontal line in the selected data mapping mode. The storage unit 111 may be implemented with an electrically erasable programmable read-only memory (EEPROM).

Therefore, when the screen of a liquid crystal panel is rotated, for example, 180 degrees, the timing controller TC newly maps image data of one horizontal line and data driver DD changes the latch orders of the odd latches and even latches, so that an image can be correctly seen to the user even though the screen is rotated.

On the other hand, in order to change output positions of image data of one horizontal line in any one mode including the second mode, the timing controller TC stores image data of one horizontal line externally supplied thereto in a line memory 115. That is, in order to change positions between different sub-image data, odd sub-image data and even sub-image data, it is first necessary to receive all k odd sub-image data and k even sub-image data. For this reason, there is a need to store image data of one horizontal line including the k odd sub-image data and k even sub-image data in the line memory 115. The timing controller TC changes output positions of image data of one horizontal line stored in the line memory 115.

Figure 2:
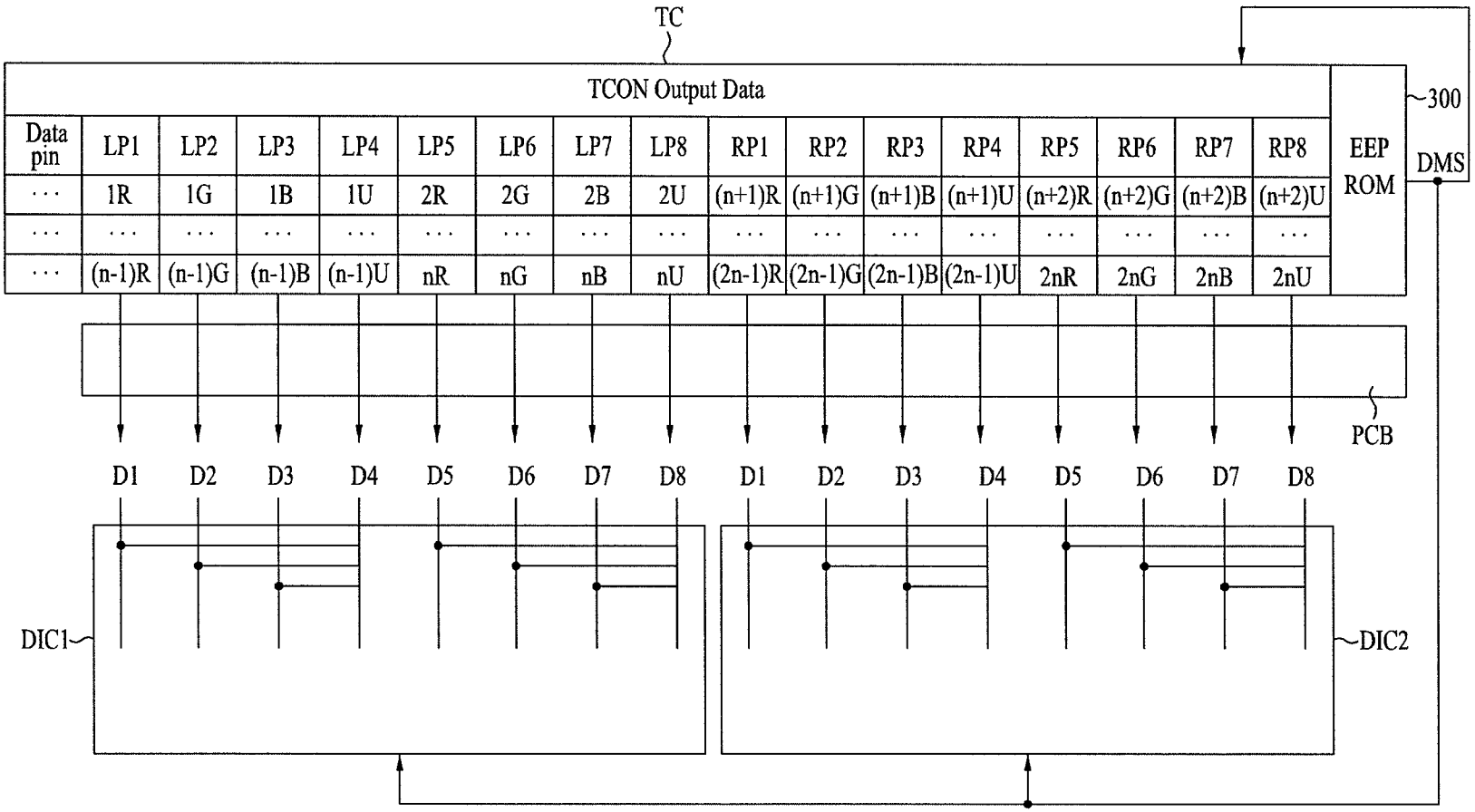
FIG. 2 is a view illustrating the operation of a timing controller in FIG. 1.

FIG. 2 illustrates the operation of the timing controller TC in FIG. 1.

As shown in FIG. 2, the data driver DD includes a first data drive integrated circuit (IC) DIC1 and a second data drive IC DIC2. Although any number of data drive ICs may be included in the data driver DD, two data drive ICs will be described as an example to be included in the data driver DD for the convenience of description.

Image data corresponding to one horizontal line are mapped in the timing controller TC, as shown in FIG. 2. These image data of the one horizontal line include k odd sub-image data to be displayed on a half horizontal line located at the right part of the screen of the liquid crystal panel, and k even sub-image data to be displayed on a half horizontal line located at the left part of the screen of the liquid crystal panel. According to a mapping result to be described later, the k odd sub-image data may be displayed on the half horizontal line located at the left part of the screen of the liquid crystal panel, and the k even sub-image data may be displayed on the half horizontal line located at the right part of the screen of the liquid crystal panel.

Each of the k odd and even sub-image data includes first red image data, first green image data, first blue image data, first red/green/blue image data, second red image data, second green image data, second blue image data, and second red/green/blue image data. That is, one sub-image data (odd sub-image data or even sub-image data) includes a total of eight image data, concretely, two red image data, two green image data, two blue image data and two red/green/blue image data. Although one sub-image data (hereinafter, 'sub-image data' refers to 'odd sub-image data' or 'even sub-image data') may include any number of image data, it is assumed in the present invention that one sub-image data includes eight image data as stated above for the convenience of description.

The first red image data means 1R, . . . , (n−1)R, . . . , (n+1)R, . . . , (2n−1)R image data, the first green image data means 1G, . . . , (n−1)G, . . . , (n+1)G, . . . , (2n−1)G image data, the first blue image data means 1B, . . . , (n−1)B, . . . , (n+1)B, . . . , (2n−1)B image data, the first red/green/blue image data means 1U, . . . , (n−1)U, . . . , (n+1)U, . . . , (2n−1)U image data, the second red image data means 2R, . . . , nR, . . . , (n+2)R, . . . , 2nR image data, the second green image data means 2G, . . . , nG, . . . , (n+2)G, . . . , 2nG image data, the second blue image data means 2B, . . . , nB, . . . , (n+2)B, . . . , 2nB image data, and the second red/green/blue image data means 2U, . . . , nU, . . . , (n+2)U, . . . , 2nU image data.

On the other hand, R, G, B and U image data having the same numeral are data for constituting one unit image. For example, the 1R, 1G, 1B and 1U image data are unit image data for expressing one unit image.

The first red/green/blue image data includes a most significant bit of the first red image data, a most significant bit of the first green image data, and a most significant bit of the first blue image data. The second red/green/blue image data includes a most significant bit of the second red image data, a most significant bit of the second green image data, and a most significant bit of the second blue image data.

The first red image data, first green image data, first blue image data, second red image data, second green image data and second blue image data are each 8-bit data, and the first red/green/blue image data and second red/green/blue image data are each 6-bit data.

Eight image data included in one odd sub-image data are simultaneously outputted respectively through first to eighth odd output pins LP1 to LP8 of the timing controller TC and then supplied respectively to first to eighth input pins D1 to D8 of the first data drive IC DIC1 through a printed circuit board (PCB). In the first data drive IC DIC1, the first to third input pins D1 to D3 are connected in common to the fourth input pin D4, and the fifth to seventh input pins D5 to D7 are connected in common to the eighth input pin D8. As a result, the image data inputted to the fourth input pin D4 is added to each of the image data to the first input pint D1, the image data to the second input pin D2 and the image data to the third input pin D3.

Eight image data included in one even sub-image data are simultaneously outputted respectively through first to eighth even output pins RP1 to RP8 of the timing controller TC and then supplied respectively to first to eighth input pins D1 to D8 of the second data drive IC DIC2 through the PCB. In the second data drive IC DIC2, the first to third input pins D1 to D3 are connected in common to the fourth input pin D4, and the fifth to seventh input pins D5 to D7 are connected in common to the eighth input pin D8. As a result, the image data inputted to the fourth input pin D4 is added to each of the image data to the first input pint D1, the image data to the second input pin D2 and the image data to the third input pin D3.

Here, the k odd and even image data are outputted in the following order.

First, eight image data located at the left part of a first row, namely, 1R, 1G, 1B, 1U, 2R, 2G, 2B and 2U image data are simultaneously outputted respectively through the first to eighth odd output pins LP1 to LP8 and eight image data located at the right part of the first row, namely, (n+1)R, (n+1)G, (n+1)B, (n+1)U, (n+2)R, (n+2)G, (n+2)B and (n+2)U image data are simultaneously outputted respectively through the first to eighth even output pins RP1 to RP8. Then, eight image data located at the left part of a second row, namely, 3R, 3G, 3B, 3U, 4R, 4G, 4B and 4U image data are simultaneously outputted respectively through the first to eighth odd output pins LP1 to LP8 and eight image data located at the right part of the second row, namely, (n+3)R, (n+3)G, (n+3)B, (n+3)U, (n+4)R, (n+4)G, (n+4)B and (n+4)U image data are simultaneously outputted respectively through the first to eighth even output pins RP1 to RP8, . . . , eight image data located at the left part of a kth row, namely, (n−1)R, (n−1)G, (n−1)B, (n−1)U, nR, nG, nB and nU image data are simultaneously outputted respectively through the first to eighth odd output pins LP1 to LP8 and eight image data located at the right part of the kth row, namely, (2n−1)R, (2n−1)G, (2n−1)B, (2n−1)U, 2nR, 2nG, 2nB and 2nU image data are simultaneously outputted respectively through the first to eighth even output pins RP1 to RP8.

The first data drive IC DIC1 latches the sequentially supplied k odd sub-image data in order using the k odd latches, and the second data drive IC DIC2 latches the sequentially supplied k even sub-image data in order using the k even latches.

Hereinafter, a description will be given of various data mapping modes of the timing controller TC.

FIG. 3 shows an arranged state of image data of one horizontal line stored in the timing controller TC under the condition that a separate data mapping is not performed.

FIG. 4 illustrates a data mapping according to a first embodiment of the present invention.

The data mapping illustrated in FIG. 4 is based on the first mode. From a comparison between FIG. 3 and FIG. 4, it can be seen that the output positions of first red image data and second blue image data are transposed with each other.

That is, as shown in FIG. 4, the timing controller TC outputs the first blue image data in the odd sub-image data through the first odd output pin LP1, outputs the first green image data in the odd sub-image data through the second odd output pin LP2, outputs the first red image data in the odd sub-image data through the third odd output pin LP3, outputs the first red/green/blue image data in the odd sub-image data through the fourth odd output pin LP4, outputs the second blue image data in the odd sub-image data through the fifth odd output pin LP5, outputs the second green image data in the odd sub-image data through the sixth odd output pin LP6, outputs the second red image data in the odd sub-image data through the seventh odd output pin LP7, outputs the second red/green/blue image data in the odd sub-image data through the eighth odd output pin LP8, outputs the first blue image data in the even sub-image data through the first even output pin RP1, outputs the first green image data in the even sub-image data through the second even output pin RP2, outputs the first red image data in the even sub-image data through the third even output pin RP3, outputs the first red/green/blue image data in the even sub-image data through the fourth even output pin RP4, outputs the second blue image data in the even sub-image data through the fifth even output pin RP5, outputs the second green image data in the even sub-image data through the sixth even output pin RP6, outputs the second red image data in the even sub-image data through the seventh even output pin RP7, and outputs the second red/green/blue image data in the even sub-image data through the eighth even output pin RP8.

FIG. 5 illustrates a data mapping according to a second embodiment of the present invention.

The data mapping illustrated in FIG. 5 is based on the first mode. From a comparison between FIG. 3 and FIG. 5, it can be seen that the output position of odd unit image data consisting of first red image data, first green image data, first blue image data and first red/green/blue image data and the output position of even unit image data consisting of second red image data, second green image data, second blue image data and second red/green/blue image data are transposed with each other.

That is, as shown in FIG. 5, the timing controller TC outputs the second blue image data in the odd sub-image data through the first odd output pin LP1, outputs the second green image data in the odd sub-image data through the second odd output pin LP2, outputs the second red image data in the odd sub-image data through the third odd output pin LP3, outputs the second red/green/blue image data in the odd sub-image data through the fourth odd output pin LP4, outputs the first blue image data in the odd sub-image data through the fifth odd output pin LP5, outputs the first green image data in the odd sub-image data through the sixth odd output pin LP6, outputs the first red image data in the odd sub-image data through the seventh odd output pin LP7, outputs the first red/green/blue image data in the odd sub-image data through the eighth odd output pin LP8, outputs the second blue image data in the even sub-image data through the first even output pin RP1, outputs the second green image data in the even sub-image data through the second even output pin RP2, outputs the second red image data in the even sub-image data through the third even output pin RP3, outputs the second red/green/blue image data in the even sub-image data through the fourth even output pin RP4, outputs the first blue image data in the even sub-image data through the fifth even output pin RP5, outputs the first green image data in the even sub-image data through the sixth even output pin RP6, outputs the first red image data in the even sub-image data through the seventh even output pin RP7, and outputs the first red/green/blue image data in the even sub-image data through the eighth even output pin RP8.

FIG. 6 illustrates a data mapping according to a third embodiment of the present invention.

The data mapping illustrated in FIG. 6 is based on the first mode. From a comparison between FIG. 3 and FIG. 6, it can be seen that the respective output positions of first red image data, first green image data, first blue image data and first red/green/blue image data are changed and the respective output positions of second red image data, second green image data, second blue image data and second red/green/blue image data are changed.

That is, as shown in FIG. 6, the timing controller TC outputs the first red/green/blue image data in the odd sub-image data through the first odd output pin LP1, outputs the first red image data in the odd sub-image data through the second odd output pin LP2, outputs the first green image data in the odd sub-image data through the third odd output pin LP3, outputs the first blue image data in the odd sub-image data through the fourth odd output pin LP4, outputs the second red/green/blue image data in the odd sub-image data through the fifth odd output pin LP5, outputs the second red image data in the odd sub-image data through the sixth odd output pin LP6, outputs the second green image data in the odd sub-image data through the seventh odd output pin LP7, outputs the second blue image data in the odd sub-image data through the eighth odd output pin LP8, outputs the first red/green/blue image data in the even sub-image data through the first even output pin RP1, outputs the first red image data in the even sub-image data through the second even output pin RP2, outputs the first green image data in the even sub-image data through the third even output pin RP3, outputs the first blue image data in the even sub-image data through the fourth even output pin RP4, outputs the second red/green/blue image data in the even sub-image data through the fifth even output pin RP5, outputs the second red image data in the even sub-image data through the sixth even output pin RP6, outputs the second green image data in the even sub-image data through the seventh even output pin RP7, and outputs the second blue image data in the even sub-image data through the eighth even output pin RP8.

FIG. 7 illustrates a data mapping according to a fourth embodiment of the present invention.

The data mapping illustrated in FIG. 7 is based on the second mode. From a comparison between FIG. 3 and FIG. 7, it can be seen that the output positions of odd sub-image data and even sub-image data are transposed with each other.

That is, as shown in FIG. 7, the timing controller TC outputs the first red image data in the even sub-image data through the first odd output pin LP1, outputs the first green image data in the even sub-image data through the second odd output pin LP2, outputs the first blue image data in the even sub-image data through the third odd output pin LP3, outputs the first red/green/blue image data in the even sub-image data through the fourth odd output pin LP4, outputs the second red image data in the even sub-image data through the fifth odd output pin LP5, outputs the second green image data in the even sub-image data through the sixth odd output pin LP6, outputs the second blue image data in the even sub-image data through the seventh odd output pin LP7, outputs the second red/green/blue image data in the even sub-image data through the eighth odd output pin LP8, outputs the first red image data in the odd sub-image data through the first even output pin RP1, outputs the first green image data in the odd sub-image data through the second even output pin RP2, outputs the first blue image data in the odd sub-image data through the third even output pin RP3, outputs the first red/green/blue image data in the odd sub-image data through the fourth even output pin RP4, outputs the second red image data in the odd sub-image data through the fifth even output pin RP5, outputs the second green image data in the odd sub-image data through the sixth even output pin RP6, outputs the second blue image data in the odd sub-image data through the seventh even output pin RP7, and outputs the second red/green/blue image data in the odd sub-image data through the eighth even output pin RP8.

FIG. 8 illustrates a data mapping according to a fifth embodiment of the present invention.

The data mapping illustrated in FIG. 8 is based on a combination of the first and second modes. From a comparison between FIG. 3 and FIG. 8, it can be seen that the respective output positions of first red image data, first green image data, first blue image data and first red/green/blue image data are changed, the respective output positions of second red image data, second green image data, second blue image data and second red/green/blue image data are changed and the output positions of odd sub-image data and even sub-image data are transposed with each other. In other words, the data mapping illustrated in FIG. 8 is a combination of the data mapping of FIG. 6 and the data mapping of FIG. 7.

That is, as shown in FIG. 8, the timing controller TC outputs the first red/green/blue image data in the even sub-image data through the first odd output pin LP1, outputs the first red image data in the even sub-image data through the second odd output pin LP2, outputs the first green image data in the even sub-image data through the third odd output pin LP3, outputs the first blue image data in the even sub-image data through the fourth odd output pin LP4, outputs the second red/green/blue image data in the even sub-image data through the fifth odd output pin LP5, outputs the second red image data in the even sub-image data through the sixth odd output pin LP6, outputs the second green image data in the even sub-image data through the seventh odd output pin LP7, outputs the second blue image data in the even sub-image data through the eighth odd output pin LP8, outputs the first red/green/blue image data in the odd sub-image data through the first even output pin RP1, outputs the first red image data in the odd sub-image data through the second even output pin RP2, outputs the first green image data in the odd sub-image data through the third even output pin RP3, outputs the first blue image data in the odd sub-image data through the fourth even output pin RP4, outputs the second red/green/blue image data in the odd sub-image data through the fifth even output pin RP5, outputs the second red image data in the odd sub-image data through the sixth even output pin RP6, outputs the second green image data in the odd sub-image data through the seventh even output pin RP7, and outputs the second blue image data in the odd sub-image data through the eighth even output pin RP8.

As described above, according to the present invention, it is possible to change output positions of image data of one horizontal line in various data mapping modes to show a correct image to the user even when a screen is rotated.

As apparent from the above description, according to the present invention, output positions of image data can be changed through various data mappings, thereby showing a correct image even though a screen is rotated.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device comprising:

a storage unit for storing a plurality of screen change signals; and a timing controller for dividing image data of one horizontal line externally supplied thereto into k odd sub-image data and k even sub-image data, and sequentially outputting the k odd sub-image data and sequentially outputting the k even sub-image data; and a data driver comprising k odd latches for sequentially receiving the k odd sub-image data from the timing controller and sequentially latching the received k odd sub-image data, and k even latches for sequentially receiving the k even sub-image data from the timing controller and sequentially latching the received k even sub-image data, wherein the k odd sub-image data is displayed on a half horizontal line located at the right part of a screen of a liquid crystal panel, wherein the k even sub-image data is displayed on a half horizontal line located at the left part of the screen of the liquid crystal panel, wherein each of the k odd and even sub-image data includes first red image data, first green image data, first blue image data, first red/green/blue image data, second red image data, second green image data, second blue image data, and second red/green/blue image data, wherein the first red/green/blue image data includes a most significant bit of the first red image data, a most significant bit of the first green image data, and a most significant bit of the first blue image data, wherein the second red/green/blue image data includes a most significant bit of the second red image data, a most significant bit of the second green image data, and a most significant bit of the second blue image data, and wherein, in the first mode, the timing controller outputs the second blue image data in the odd sub-image data through a first odd output pin, outputs the second green image data in the odd sub-image data through a second odd output pin, outputs the second red image data in the odd sub-image data through a third odd output pin, outputs the second red/green/blue image data in the odd sub-image data through a fourth odd output pin, outputs the first blue image data in the odd sub-image data through a fifth odd output pin, outputs the first green image data in the odd sub-image data through a sixth odd output pin, outputs the first red image data in the odd sub-image data through a seventh odd output pin, outputs the first red/green/blue image data in the odd sub-image data through an eighth odd output pin, outputs the second blue image data in the even sub-image data through a first even output pin, outputs the second green image data in the even sub-image data through a second even output pin, outputs the second red image data in the even sub-image data through a third even output pin, outputs the second red/green/blue image data in the even sub-image data through a fourth even output pin, outputs the first blue image data in the even sub-image data through a fifth even output pin, outputs the first green image data in the even sub-image data through a sixth even output pin, outputs the first red image data in the even sub-image data through a seventh even output pin, and outputs the first red/green/blue image data in the even sub-image data through an eighth even output pin.

* * * * *